United States Patent [19]

Lincoln

[11] 4,061,336

[45] Dec. 6, 1977

[54] GEOGRAPHIC BOARD GAME

[76] Inventor: Launa J. Lincoln, 10227 Meadowood, St. Louis, Mo. 63114

[21] Appl. No.: 686,471

[22] Filed: May 14, 1976

[51] Int. Cl.[2] ..... A63F 3/04

[52] U.S. Cl. ..... 273/134 AC; 273/131 BB; 273/131 BA; 273/134 C; 273/134 D; 273/134 E; 273/134 GM; 273/137 R

[58] Field of Search ..... 273/134, 157

[56] References Cited

U.S. PATENT DOCUMENTS

| | | | |
|---|---|---|---|
| 707,469 | 8/1902 | Wayts | 273/134 AC |
| 941,680 | 11/1909 | Houghton | 273/157 R |
| 2,479,747 | 8/1949 | Lachance | 273/134 AC |
| 3,114,551 | 12/1963 | Ovitz | 273/134 AC |
| 3,362,715 | 1/1968 | Hartpence | 273/134 AC |
| 3,368,816 | 2/1968 | Milazzo et al. | 273/134 AC |

*Primary Examiner*—Delbert B. Lowe
*Attorney, Agent, or Firm*—Rogers, Eilers & Howell

[57] ABSTRACT

A travel game uses a puzzle map of the United States of America with the removable states as the playing surface. Tokens reflecting different modes of travel are used to represent a player's position in making trips between a start state and a destination state, each being marked with an "S" or "D" token. Spinners are used to randomly determine a player's mode of travel and the length of his move. Reward cards and penalty cards contain special instructions modifying a regular move. Optional insurance is available to protect against some of the penalties. Play money is used to pay fees and penalties. Bonuses and rewards may be collected during play.

8 Claims, 10 Drawing Figures

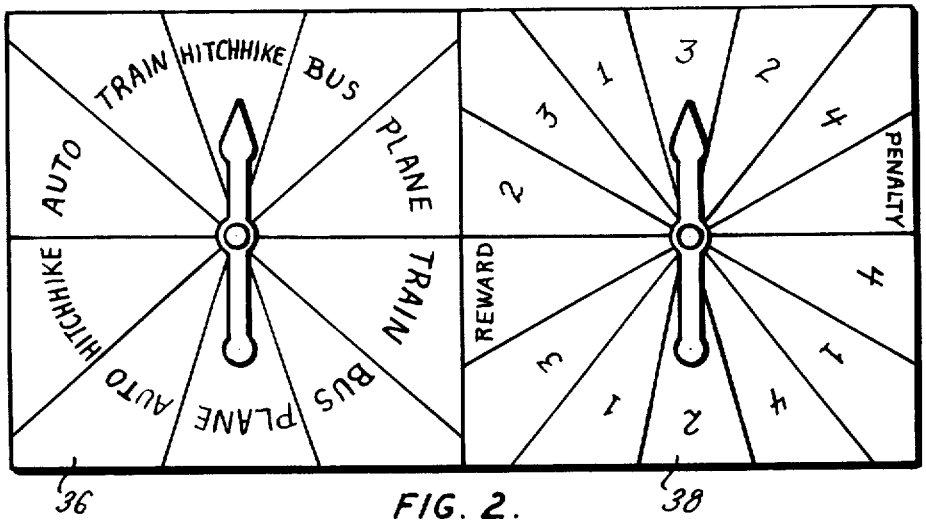
FIG. 2.
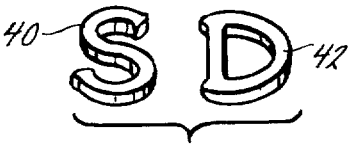
FIG. 3.
FIG. 4.
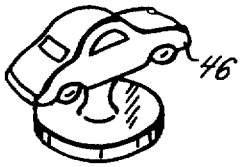
FIG. 5.
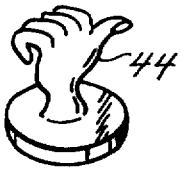
FIG. 6.
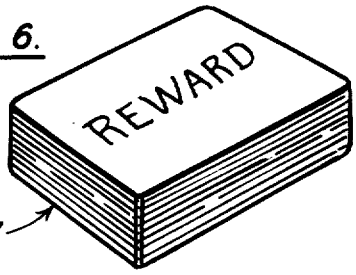
FIG. 7.
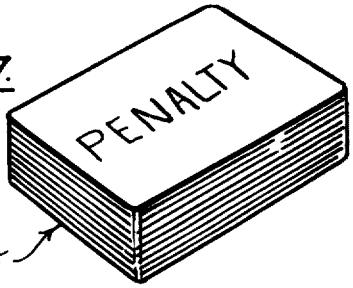
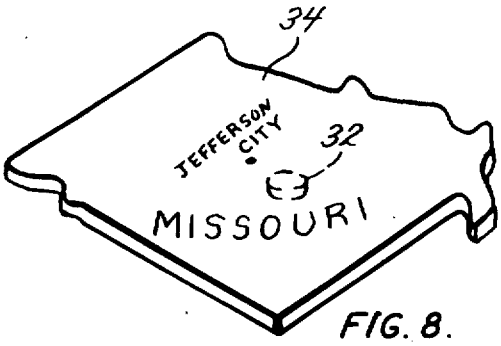
FIG. 8.
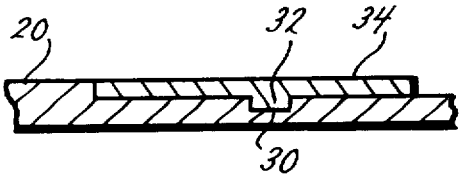
FIG. 10.
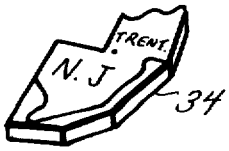
FIG. 9.

GEOGRAPHIC BOARD GAME

BACKGROUND AND SUMMARY OF THE INVENTION

Board games are well known to the public generally. The game of Monopoly (TM), for example, is very popular. Some known games combine a randomizing device to determine the move of each player, a confined path on the board for movement, and elements of chance rewards or penalties, with a goal each player tries to attain to become the winner. These types of games can be characterized as "strategy" type games in that a player's skill in making decisions during the course of the game plays a predominate role in determining the winner.

In contrast to the "strategy" games, some other board games involve little decision making by the players. The winner of these games is determined predominately by the luck of the player in "throwing the die" which advances the player's token. These types of games may be called "chance" games.

Geographical puzzle games, of the "chance" type, are also known. They consist of a map of a chosen geographical area and puzzle pieces which duplicate that area. The players try to position various pieces of the puzzle over the proper places on the map to complete the puzzle. These games have the added feature of teaching a player some geography while playing a simple type of game.

Applicant's game is unique in that it combines the elements of strategy and chance into a travel game played on a map type board where the puzzle pieces placed in position on the board during the course of the game define the playing area. This new game is entertaining and has the added benefit of teaching the players the geography of any chosen area.

Although applicant's game utilizes a flat map board in the preferred embodiment, a non-planar surface, including a sphere, could be used to define a chosen geographic area, such as the Earth or other planets.

While the game is easily learned, there are several levels of decision making combined with random happenings which insure numerous possibilities for the course of the game to follow. These features make the game interesting to play and require a certain degree of concentration in either learning or playing.

The object of the game is to accumulate the most money during the course of the game. A player makes money by arriving at his "destination" or by drawing one of the reward cards which pays money. For a player to reach a "destination", he must begin at a "start" location and successfully negotiate the distance between. The "start" and "destination" locations are randomly chosen. The length of a player's move is randomly chosen, for example, by a number, a reward card or a penalty card. The path traveled between "start" and "destination" is decided by the player, subject to some restrictions in the rules. During a trip a player is subject to being "bumped" by another player, which returns him to his "start." A penalty or reward card may detour a player.

A player pays out money by paying travel fees for each border he crosses during his trip and for certain of the penalty cards. The amount of the travel fees depends upon both the mode of travel and the number of borders crossed.

Some penalty cards require the player to pay out money, unless the player has purchased optional "insurance" for this trip. The amount paid for insurance varies with the mode of travel.

When a player reaches his "destination", that location becomes his "start" and he randomly selects another "destination." The game ends when the last puzzle piece is placed in position on the map and the players arrive at their last "destination." The money is then counted and the richest player wins the game.

DESCRIPTION OF THE DRAWINGS

FIG. 2 is a view of the two spinners used to randomly select a player's mode of travel and the length of a player's move;

FIG. 3 is a view of tokens used to mark a player's "start" and "destination" locations;

FIG. 4 is a view of the token a player uses when he has selected the auto travel mode;

FIG. 5 is a view of the token a player uses when he has selected the hitchhike travel mode;

FIG. 6 represents a stack of reward cards;

FIG. 7 represents a stack of penalty cards;

FIG. 8 shows a puzzle piece of the State of Missouri;

FIG. 9 shows a puzzle piece of the State of New Jersey; and

FIG. 10 is a side view of the playing surface depicting a puzzle piece state in place on the board.

DESCRIPTION OF THE PREFERRED EMBODIMENT

Figure 1:
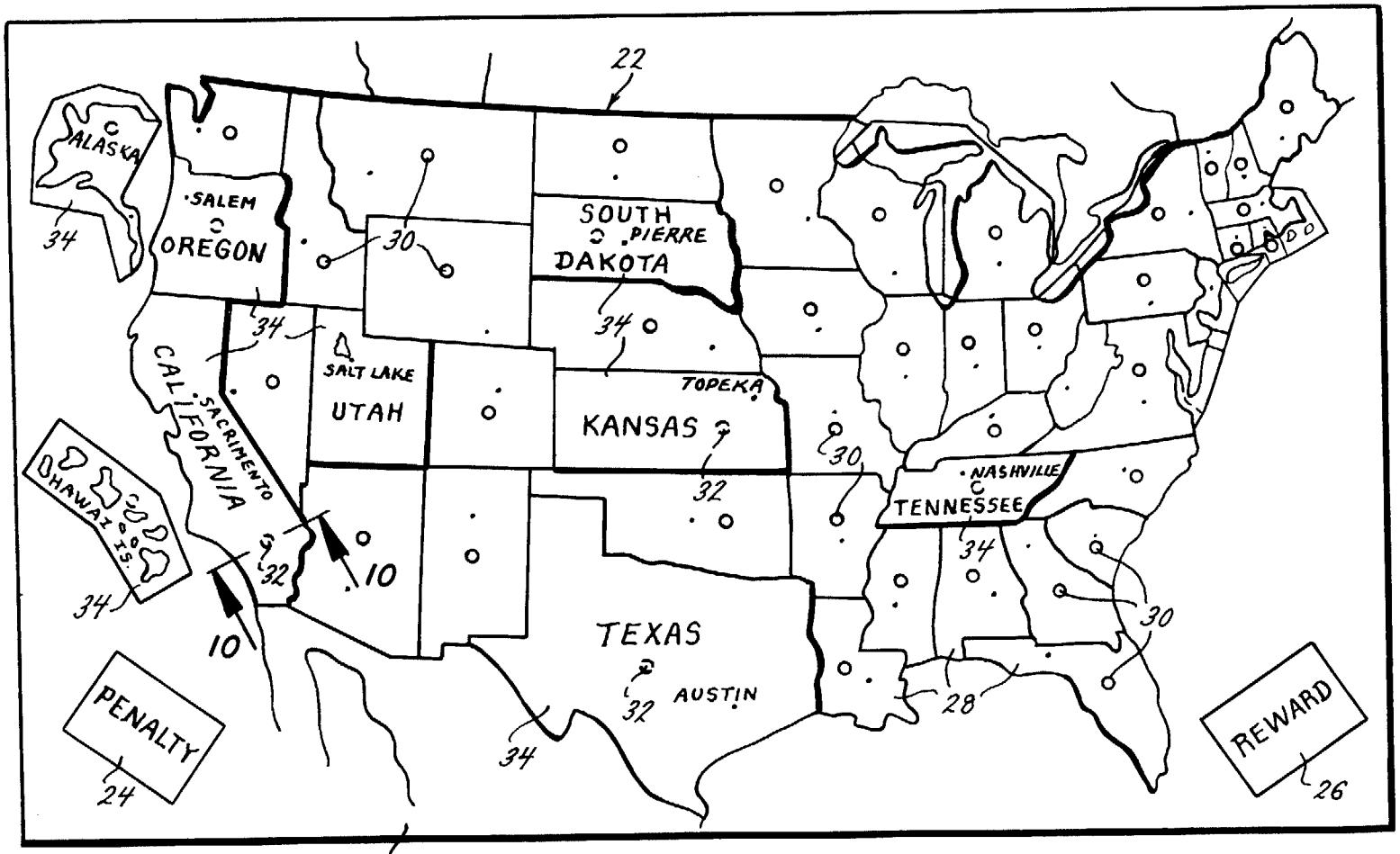
FIG. 1 is a drawing of the playing board which is comprised of a map of the United States of America, including Alaska and Hawaii, and designated locations to stack the penalty and reward cards.

The playing board 20 shown in FIG. 1 includes the playing surface which is a map 22 of the contiguous 48 states and the states of Alaska and Hawaii. The map 22 may be recessed or flat. The playing board 20 has location 24 for the stack of penalty cards 25 and location 26 for the stack of reward cards. The penalty and reward cards 25 and 27 are shown in FIGS. 6 and 7.

Map 22 has a plurality of locations 28 which have the outline of a particular state. Each location 28 for a state on the board 20 may have a locating hole 30, as shown in FIG. 10, which receives a locating nib 32 on a corresponding state puzzle piece or plaque 34, shown in FIGS. 8–10. This locating nib 32 secures the puzzle piece or plaque 34 in place once it is in position on the map 22. FIG. 10 shows a side sectional view of a state puzzle piece 34 in position on the board showing the locating nib 32 fitted into the locating hole 30. However, it may be desirable in some instances to adjust the scale of some plaques 34. For example, the scale of Texas and Alaska could be reduced and the scale of Rhode Island, Vermont, and Connecticut could be expanded to make the pieces easier to handle. The proportions of the entire map could be adjusted, if desired.

The two randomizing devices required to select mode of travel and length of move are shown in FIG. 2 as spinners 36 and 38. Spinners 36 and 38 are shown mounted together, but could be separately mounted. Any other type of randomizing device such as dice, a deck of cards, or even a table of random numbers could be used.

Player tokens 40 and 42 include an "S" and a "D", as shown in FIG. 3, and are used to designate the "start"

state and "destination" state for trips made during the course of the game.

A player's position on the map during the game is represented by one of five tokens. The token used varies with the mode of travel selected for each trip. For example, if a player spins "hitchhike", then the hitchhike token 44, shown in FIG. 5, is used for that trip. Token 46 is used if the automobile mode is chosen. After completing that trip, the player spins again to determine his mode of travel for his next trip. A player may use each of the five travel tokens during the course of the game, and may use some tokens several times. Table III lists the five travel modes, i.e., plane, bus, railroad, automobile and hitchhike.

A complete set of tokens for each player includes one each for auto, train, hitchhike, bus and plane, and includes the "S" and "D" tokens. Each player's tokens are differentiated by color. As many as eight players can play simultaneously.

A penalty card 25 or a reward card 27 is drawn when spinner 38 indicates a penalty or a reward.

Other equipment required to play the game is a supply of play money (not shown) in denominations of $1,000, $500, $100, $50, $20, $10, $5 and $1 and travel insurance cards (not shown) which are issued to a player upon purchase of travel insurance for a trip and used as proof of purchase. The insurance values are shown in Table III.

THE PLAY OF THE GAME

The playing board 20 is placed on a table or other convenient location. The reward cards 27 and penalty cards 25 are then shuffled and placed face down in their respective positions 26 and 24 on the board 20. The fifty state puzzle pieces or plaques 34, as they are called, are placed in a reserve pile or "kitty" and randomized. Each player is issued $1,250 in denominations of one $500, three $100, five $50, six $20, five $10, five $5 and five $1 in play money bills from the bank. Each player chooses a color and selects the "S" 40 and "D" 42 and five travel tokens of that color from the bank. A travel agent is selected to supervise play which includes issuing and receiving funds and insurance from the bank. The travel agent may also play as a traveler, but if he does he must keep his traveler's funds separate from the bank. The travel agent remains on duty until the end of the game, even though he may be eliminated from playing in the game by becoming a derelict traveler.

Beginning with the agent, each traveler spins the numbered spinner 38 in turn. The player receiving the highest number begins play by selecting first a "start" and then a "destination" state plaque 34 from the "kitty." This selection is done as randomly as possible by the agent holding the "kitty" at or above the eye level of the traveler and by requiring the traveler to select as rapidly as possible. Once selected, the state plaques 34 are positioned on the board in their proper location and the traveler places his "S" 40 and "D" 42 tokens on the plaques 34. Positioning plaques 34 and tokens 40 and 42 ends that player's turn. Play continues counterclockwise around the board until each player has selected, positioned and marked his start and destination states.

Then the traveler who first selected plaques 34 spins the mode spinner 36 to select his mode of travel, places the appropriate token for that mode on his start state, and decides whether to buy travel insurance.

Travel insurance must be purchased separately for each trip as the policy "expires" each time a traveler reaches his destination state. The benefit of travel insurance is that it will allow a player to escape the penalty on several of the penalty cards 25 which he may be forced to draw during his trip. The cost of travel insurance varies with the mode of travel as shown in Table III, except that it is not available when a player travels in the hitchhiking mode.

After deciding about travel insurance, a traveler begins his trip by spinning the numbered spinner 38. The possible results are 1, 2, 3, 4, reward or penalty. The numbers represent the number of state lines the traveler must cross in that turn - one, two, three or four. Reward and penalty require that the traveler draw a reward card 27 or a penalty card 25.

Travel is by exact count of state lines with no doubling back over state lines previously crossed during the same move. For all modes but plane, the state plaques 34 must be in place on the board with no other traveler's mode token on the plaques 34 for a traveler to count through it. A traveler may count through a state plaque 34 with an "S" token 40 or "D" token 42 on it. All travelers may land only on state plaques 34 in positions which either are vacant or are occupied by another traveler's mode token. Travelers in the plane mode can travel over an empty space but are subject to the same landing requirements of the other modes. When one traveler lands on a plaque 34 occupied by another traveler's token, the late arriver "bumps" the occupant back to his start state to begin his trip over again. As there is no requirement that a player choose any particular path in traveling from start to destination, he may decide to either bump another player or detour to avoid bumping, as he sees fit. After a traveler has completed his move, he selects a state plaque from the kitty and places it on the board.

After having spun a number on the numbered spinner 38, a traveler may move either as normal, or elect not to move, or it may be impossible for him to move. Normal moving follows the procedure described above. If it is possible for a player to move, but he desires not to, he can elect not to move. An election not to move forfeits his turn and his right to draw a plaque 34 from the kitty. If it is impossible to move the number of state lines spun, he forfeits his turn but maintains the right to draw a plaque 34 from the kitty to place on the map 22.

Upon reaching his destination plaque 34, by exact count, a traveler removes his "D" token 42 and his travel token from the board, places his "S" token 40 on the plaque 34 just reached and turns in any insurance certificate purchased for the trip to the agent. He then draws a new destination plaque 34 from the "kitty," places it on the map 22 and places his "D" token 42 on it, which ends his turn. On his next turn he starts this trip in the same manner as described above for his first trip, starting with a spin of the mode spinner 36.

The money that was distributed to each traveler at the beginning of the game is used to pay penalties, when a penalty card 25 is drawn, and state line fees for each move. Operation of the penalty cards 25 is described below. The state line fees vary with the mode of travel a traveler spins and are set out in Table III. The fee from Table III is multiplied by the number of lines crossed and paid to the bank after completion of each move. For example, if a traveler is traveling by plane and spins a 3, he would move his travel token across 3 lines, and then pay the bank three times $75 or $225. If a player elects not to move or if it is impossible for him to move, he pays no state line fees. A player who reaches his destination state can have his state line fees deducted from his bonus.

A player can earn money by either drawing a reward card which rewards him with money or by reaching his destination state for which he receives a $500 bonus from the bank.

If, during the course of the game, a traveler has insufficient funds to pay the state line fees required of him, he may elect not to advance and wait for a reward spin. If a traveler has insufficient funds to comply with a reward card 26 or penalty card 24 instruction, however, he is out of the game. A player out of the game removes all his tokens from the map 22 and gives his money to the rewarded player or the bank, depending on the particular card's instruction.

There are special travel mode and state line requirements for Alaska and Hawaii. If Hawaii is selected as a destination state, the traveler must travel by plane so he is assigned the plane mode and doesn't spin the travel mode spinner 36. Hawaii can only be reached from the states of California, Oregon or Washington and is three state lines away. If Alaska is selected as a destination state, the traveler must spin the mode spinner 36 each turn until he spins a mode of plane, bus or auto. A spin of any other mode ends the player's turn. It is possible that he wouldn't start his trip until after several unsuccessful attempts in spinning an acceptable mode. Alaska is accessible through the state of Washington and is two state lines away. This procedure is unique and is only followed when Alaska is chosen as a destination.

Reward cards 26, and penalty cards 24, are listed in Tables I and II along with instructions for their use during the play of the game. It should be noted that some of the reward cards 27 can be retained for later use while all the penalty cards 25 must be played immediately. In either event, the card must be disclosed to all players when it is used. Another difference in play is that reward cards 27 do not always end a player's turn while penalty cards 25 do. This is true even if a particular penalty is inapplicable to a player's travel mode or position. Once either penalty cards 25 or reward cards 27 are played, they are returned to the bottom of their stacks for continued play. If a player's turn is ended by either of these, he does not draw a plaque 34 from the "kitty."

The winner of the game is the traveler who has accumulated the most money at the end of the game. The game ends when the last state plaque 34 has been placed on the map 22 and the last destination has been reached for each traveler. Thus, play can continue for many moves after the last plaque 34 is in position if players are bumped back to their start state or choose to detour. However, once all the plaques 34 are in place, a traveler must advance unless he has insufficient funds. Once a player reaches his final destination he removes all his tokens from the map 22 and counts his money while awaiting the last player to reach his destination.

It will be appreciated that one skilled in the art could modify the invention disclosed to vary the form or conduct of the game without departing from its basic concepts and structure. Applicant is not to be limited to the specific embodiment disclosed, but only by the scope of the appended claims.

TABLE I

| | | Reward Cards | | |
|---|---|---|---|---|
| Card No. | Legend | Explanation | Ends Turn | Must Play Immediately |
| 1. | Advance two unoccupied states without fee. Do not bump or overrun destination. Pass spinner to next traveler | Unless player is in "Plane" travel mode, he must move if there are two plaques in position on board adjacent to state he is in. He doesn't pay any state line fees. If in plane mode, he can jump one state. | Yes | Yes |
| 2. | Advance to next unoccupied state. Do not bump. Pass spinner to next player. | Same as above, except no difference in movement for "Plane" traveler. | Yes | Yes |
| 3. | The agent awards you a $100 refund and another spin. | Player gets paid $100 from bank and spins again. | No | Yes |
| 4. | This is a free ride. Move directly to destination, collect $500 bonus and select new destination. | This card suspends all rules. Player places token on "Destination" state; receives $500 from bank for reaching destination, selects new state plaque. | Yes | No |
| 5. | Free pass to this "Destination". Spin to advance but pay no fees. Pass spinner to next traveler | Play continues as normal but player pays no state line fees for this trip | Yes | Yes |
| 6 | Hold this card until you wish to claim half the reward or "Destination" bonus of another. Spin again. | When any other player announces that he gets money from bank, this card can be played to collect ½/ Note: There are two of these cards. | No | No |
| 7. | Collect fee for your method of travel from agent at each state line until you reach destination. | Instead of paying state line fees, player collects them from bank | Yes | Yes |
| 8. | Entitles you to re- | When another player | No | No |

TABLE I-continued

| Card No. | Legend | Reward Cards<br>Explanation | Ends Turn | Must Play Immediately |
|---|---|---|---|---|
| | bound a traveler trying to bump you. Hold card and spin again. | lands on the state occupied by player with this card, card is played and overtaking player returns to his "start" state | | |
| 9. | Entitles you to rebound a traveler trying to bump you. Hold card and pass spinner to next traveler | Same as 8 except it ends your turn. | Yes | No |
| 10. | Free pass to your destination. Spin to advance but pay no fee. You may spin again-immediately. | Same as 5 except it doesn't end your turn. | No | Yes |
| 11. | Remove an unoccupied state from the board: draw another (new) state and place on board. SPIN AGAIN. | Any state plaque except a player's "start" or "destination" state can be removed. | No | Yes |
| 12. | This is a free airplane ride to your next destination-no fees at state lines. SPIN AGAIN. | Player must first reach his present "destination". He then is awarded "plane" travel mode. No state line fees in moving otherwise normally to the next "destination" state he selects. | No | No |
| 13. | Entitles you to collect their state line fee from each traveler. You may hold card until a later turn. SPIN AGAIN. | Once player plays this card, the next players spin mult. By his state line rate is paid to the holder of this card. If reward or penalty is spun, no money is collected from that player. | No | No |
| 14. | Collect $75 dividend if you hold insurance. SPIN AGAIN. | Collect $75 from bank if player has bought insurance for this trip. | No | Yes |
| 15. | Move token to Las Vegas and win $450. Next turn continue to destination by bank and changes to | If Nevada plaque is on the board, player moves his token there, collects $450 from | Yes | Yes |
| air, fees paid by | casino. | his plane travel token. State line fees aren't collected but player continues otherwise normally on his next turn. If Nevada not on board, card returned to deck and player's turn ended. | | |
| 16. | Insurance award pays you $275. SPIN AGAIN | Same as 14, except amount. | No | Yes |
| 17. | You reported a crime so collect a $100 reward and spin again. | Player collects $100 from bank. | No | Yes |
| 18. | Collect $25 door prize at benefit supper. | Player collects $25 from bank. | No | Yes |
| 19. | Tax adjustment in your favor. Collect $125. Pass spinner to next traveler. | Player collects $125 from bank. | Yes | Yes |
| 20. | The agent awards you a $50 refund and two spins. | Player collects $50 from bank and two more spins. | No | Yes |
| 21. | Travelers aid, collect $50. Pass spinner to next traveler. | Player collects $50 from bank. | Yes | Yes |
| 22. | If you are in New York, Illinois or Pennsylvania, collect $1000 lottery prize. | If player is not in one of the three states when card is drawn, card returned to deck. Turn ended. | Yes | Yes |
| 23. | Entitles you to charter an airplane for $25 and fly over a state not in place or occupied. You may hold card till later. | When played, used to jump over one state. State line fees and $25 must be paid. | No | No |
| | SPIN AGAIN. | | | |

TABLE II

Penalty Cards

Note: All penalty cards end the player's turn and must be used immediately.

| Card No. | Legend | Explanation |
|---|---|---|
| 1. | Detour to the nearest state beginning with "W" then continue to destination. | Player moves token to state puzzle piece, name starting with "W" crossing as few state lines as possible. If more than one state is same distance, player chooses either. If no state puzzle piece starting with "W" on board, or those on board are another player's "S" or "D" state, card is replaced at bottom of stack, no penalty. |
| 2. | You forgot to lock the house! Place token on start state and continue next turn. | Player returns his travel token to his "S" state. |
| 3. | Detour to New Orleans for Mardi Gras on the way to your destination. | Player continues to move normally, except he must travel to and occupy Louisiana before continuing to his "D" state. If Louisiana puzzle piece is not on board when card is drawn, card is replaced at bottom of stack, no penalty. Also no penalty if Louisiana is another player's "S" or "D" state. |
| 4. | Detour around the next state ahead. Miss your turn if next state ahead is destination. | Player must not occupy or count through the state which is adjacent to the state he is occupying which provides the shortest path to his "D" state. Puzzle piece must be in place for penalty to apply, unless player is in "plane" travel mode. If player is in plane travel mode, then puzzle piece need not be in place on map. |
| 5. | Mistaken identity. The police detain you for one turn. | Player must skip his next turn. |
| 6. | Visit a sick aunt in closest state beginning with "M", then continue to destination. | Player must travel to and occupy the nearest state puzzle piece which starts with "M". If none on board, or those on board are another player's "S" or "D" state. Then no penalty and card is replaced. |
| 7. | Detour to visit Disney World (Fla.) or Disneyland (Ca.) and then continue to destination. | Player must travel to and occupy either Florida or California state puzzle pieces before traveling to his "D" state. If neither puzzle piece on board, or if on board but another player's "S" or "D" state, then no penalty. If only one puzzle piece available, then player must travel to it. If both, player has choice. |
| 8. | Emergency!! Detour home to your birthplace, then continue to destination. | Player must travel to and occupy his her state of birth if puzzle piece on board and not another player's "S" or "D" state. If another player's "S" or "D" state or not on board, no penalty. |
| 9. | Witness an accident. Wait a turn to testify but receive $50 fee. | Player collects $50 from bank. Player skips his next turn. |
| 10. | Credit cards refused! Pay double fees to your destination. | Player moves normally except he pays double his state line fees normally due for this trip, for balance of this trip. |
| 11. | It is Sunday and you can't cash a check. Wait until Monday by losing your next turn | Player must skip his next turn. |
| 12. | Your destination has been declared a disaster state. Remove it. Draw a new destination state. Continue your trip to new destination on your next turn. | Player removes his "D" state and returns it to kitty. New "D" state is drawn and placed on board. |
| 13. | Luggage stolen. Pay $300 to replace belongings unless you are insured. | If player has no insurance he pays bank $300. If player has insurance, no penalty. |
| 14. | Toothache. Pay $35 dental fee unless you are insured. | If player has no insurance, he pays bank $35. If player has insurance, no penalty. |
| 15. | Minor injury. Pay $55 medical costs unless you are insured. | If player has no insurance he pays bank $55. If he has insurance, no penalty. |
| 16. | Family emergency. Pay $255 to send a money order home. | Player pays bank $255. |
| 17. | Very nasty weather. Pay $75 for an umbrella, rubbers and a raincoat. | Player pays bank $75. |
| 18. | Major breakdown! Miss two turns and pay $80 lodging costs. | Player pays bank $80 |

TABLE II-continued

Penalty Cards

Note: All penalty cards end the player's turn and must be used immediately.

| Card No. | Legend | Explanation |
|---|---|---|
| 19. | Motion sickness. Pay $65 for medicine and a night's lodging, lose next turn. | Player skips next turn. Player pays bank $65. |
| 20. | Caught in the rain! Pay $8 cleaning and pressing expenses. | Player pays bank $8. |
| 21. | Temporary loss of luggage. Pay $45 for emergency needs. | Player pays bank $45 |
| 22. | You meet an old friend. Pay $22 to entertain him. | Player pays bank $22. |
| 23. | Pay $17 for sovenir bought during your trip. | Player pays bank $17. |

TABLE III

| Travel Mode | Fare/State Line | Insurance/Trip |
|---|---|---|
| Plane | $75 | $10 |
| Bus | 35 | 30 |
| Railroad | 45 | 20 |
| Automobile | 25 | 40 |
| Hitchhiking | 10 | N/A |

What is claimed is:

1. In a game, a playing surface having divisions thereon forming distinct geographical areas, cooperating pieces to be received on some of the areas of the playing surface, means for the playing surface to retain the cooperating pieces, means to select designated areas of the playing surface as beginning and goal locations, player travel mode tokens having different move characteristics represented by the appearance of the token, means for governing the conduct of the game between the beginning location and goal including means for selecting movement of the tokens on the playing surface between the beginning and goal locations.

2. In a game, a playing surface having divisions thereon forming distinct geographical areas, cooperating pieces to be received on some of the areas of the playing surface, means for the playing surface to retain the cooperating pieces, means to select designated areas of the playing surfaces as beginning and goal locations, means to govern the conduct of the game between the beginning and the goal locations including means to designate different modes of play of the game between the beginning and goal locations, and means to grant rewards and impose penalties during conduct of the game.

3. In a game, a recessed playing surface having divisions thereon forming distinct areas, cooperating pieces to be received on some of the areas, and means to select designated areas as beginning and goal locations on the playing surface, the playing surface divisions being physically divided to form geographic areas, the areas having means defining holes adapted to receive locating nibs, the cooperating pieces being removable and having locating nibs adapted to cooperate with the holes to retain the pieces on the playing surface, the game having start and destination tokens to designate the beginning and goal locations, player mode tokens to designate move characteristics, a mode randomizer, a second randomizer to determine a player's move, penalty cards and reward cards to be drawn in response to the move randomizer, and means to be used to keep score.

4. The game of claim 1 wherein the means to govern the conduct of the game is a random means.

5. The game of claim 1 wherein means is provided to designate different modes of play of the game between the beginning and goal locations.

6. The game of claim 1 wherein means is provided to grant rewards and impose penalties during conduct of the game.

7. The game of claim 1 wherein the cooperating pieces fit together in a puzzle fashion.

8. The game of claim 1 wherein the areas have interlocking means to cooperate with means on the cooperating pieces to retain the cooperating pieces in position on the playing surface.

* * * * *